United States Patent [19]

Simonsson

[11] 4,193,292

[45] Mar. 18, 1980

[54] INDICATING DEVICE FOR VACUUM CLEANERS

[75] Inventor: Sven B. Simonsson, Tyreso, Sweden

[73] Assignee: Aktiebolaget Electrolux, Stockholm, Sweden

[21] Appl. No.: 1,144

[22] Filed: Jan. 5, 1979

[30] Foreign Application Priority Data

Jan. 11, 1978 [SE] Sweden ..... 7800296

[51] Int. Cl.[2] ..... G01L 7/08; B01D 46/04

[52] U.S. Cl. ..... 73/38; 116/268; 116/DIG. 25

[58] Field of Search ..... 73/38; 116/268, 70, 116/DIG. 25

[56] References Cited

U.S. PATENT DOCUMENTS

| | | | |
|---|---|---|---|
| 3,279,418 | 10/1966 | Nilsson | 116/70 |
| 3,474,906 | 10/1969 | Tennis | 116/70 X |
| 4,060,050 | 11/1977 | Simonsson | 116/DIG. 25 X |
| 4,070,170 | 1/1978 | Leinfelt | 116/268 X |

*Primary Examiner*—Gerald Goldberg
*Assistant Examiner*—Joseph W. Roskos
*Attorney, Agent, or Firm*—Alfred E. Miller

[57] ABSTRACT

An indicating device for vacuum cleaners, or similar apparatus, utilizing a dust container. The indicating device such as a diaphragm, is under the influence of a pressure differential and is movable against a force of a spring to give a visual indication from the outside of the vacuum cleaner of the degree of filling of the dust container therein. The motor of the vacuum cleaner has a motor regulator and the overall arrangement is provided with a unit for continuously varying the tension of the spring against the force of which the indicating device is movable.

This invention relates to an indicating device for vacuum cleaners or similar apparatus having dust container with means which under the influence of a pressure differential is movable against the force of a spring and has a signalling device visible from the outside of the means for continuous visual indication of the degree of clogging of the dust container.

7 Claims, 1 Drawing Figure

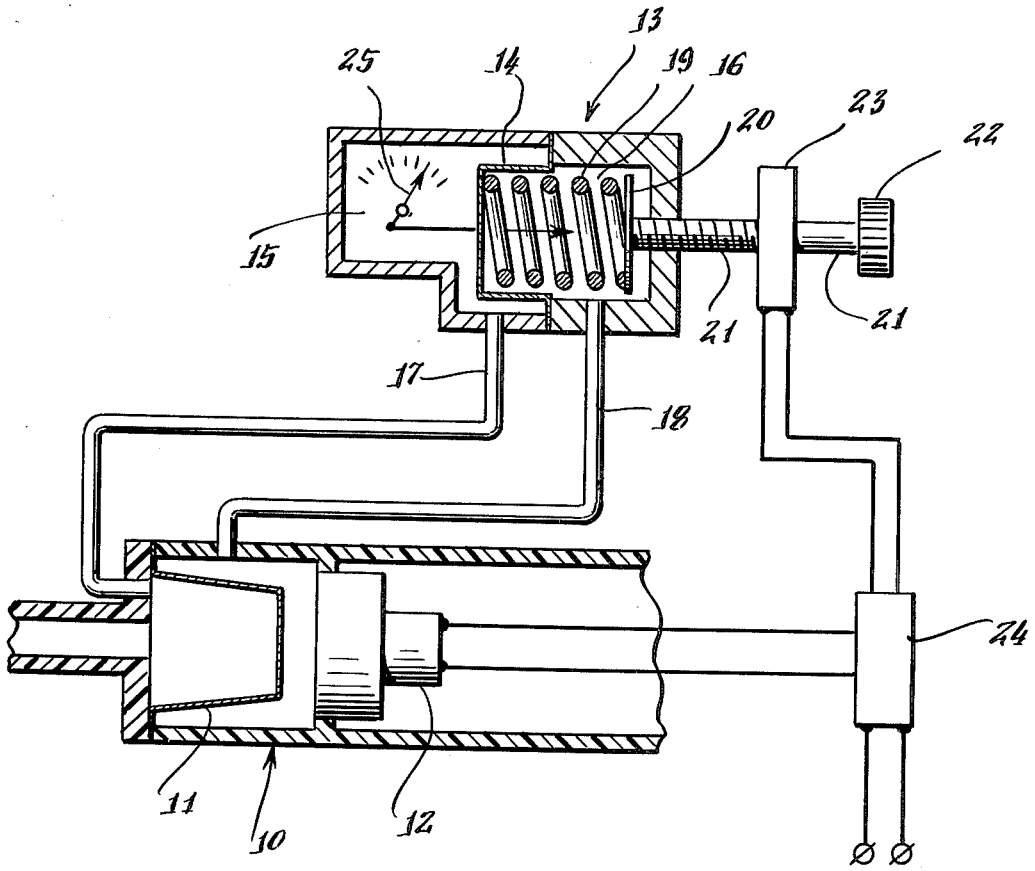
13
25
14
19
16
20
23
22
15
21
21
17
18
24
11
10
12

INDICATING DEVICE FOR VACUUM CLEANERS

BACKGROUND OF THE INVENTION

Several different types of indicating devices for providing a continuous visual indication of the degree of clogging with dirt and dust of a vacuum cleaner dust container are known. Usually the indicating device is acted upon by the pressure differential generated by the motor-fan unit of the apparatus, either between the inside, and the outside of the dust container, or between the outside of the dust container and atmospheric pressure. The device, often takes the shape of a piston, a diaphragm, or similar structure, and moves against the force of a spring, and its instantaneous position can be observed from the outside of the apparatus, and an indication of the degree of clogging of the dust container is thereby determined.

It should be evident that the spring characteristics and tension are selected so that for a motor having a certain output the end position of the movable means, such as a piston, signals that the dust container should be replaced. Such a device functions rather well in a vacuum cleaner motor having constant output but in vacuum apparatus having motor regulators where the output can be varied the conditions are no longer valid. As a consequence, under certain conditions, the indicator for the degree of clogging of the dust container gives a faulty indication. For instance, in case of partial motor output, this may result in a premature replacement of the dust container, which consequently entails an increase in the running costs of the vacuum cleaner. The indicator signals are therefore correct only for a certain position of the output regulator.

A principal object of the present inventon is to eliminate the foregoing disadvantage of prior art constructions and the invention is mainly characterized in that the vacuum cleaner, which has a motor regulator, is provided with a device for continuous varying of the tension of the spring against the force of which the means, such as a diaphragm, is movable.

DESCRIPTION OF THE PREFERRED EMBODIMENT

One embodiment of the invention will be shown and described with reference to the accompanying drawing being a sole diagrammatic FIGURE thereby further characteristic features and advantages of the present invention will be readily apparent.

The sole FIGURE in the drawing shows schematically a vacuum cleaner having an indicating device of the above-described type and a device for motor regulation. The vacuum cleaner, as a whole, is designated by the reference numeral 10 and is provided with a dust container 11 and a motor-fan unit 12. The indicator showing the degree of clogging of the dust container is designated by the reference numeral 13 and has a diaphragm 14 dividing the inner space of the indicator 13 into two parts. The first part 15 is connected to the inside of the dust container through a conduit 17, while a second conduit 18 connects the second part 16 with the outside of the dust container 11. In the part 16 a spring 19 is arranged, in which one end bears against the diaphragm 14. The other end of the spring is supported against a plate 20. The plate 20, in turn, is attached to one end of a threaded shaft 21, which is displaceable axially in the indicator housing. On its other end, the shaft 21 has a regulating means in the shape of a knob 22 of a control unit 23, i.e. a potentiometer for an electronic motor regulator 24 with the aid of which the output of the motor can be varied in a known manner. For this purpose, the knob 22 is turned in either clockwise or counter-clockwise direction and acts upon the control unit 23, which forwards the impulse to the motor regulator 24. Moreover, the side of the diaphragm, which is opposite to the spring 19, is connected to a dial 25, the latter being visible from the exterior of the apparatus.

The device functions in the following manner: First, it is assumed that the motor is working with a constant maximum output. When the difference between the absolute pressures $p_1$ and $p_2$ on the inside and the outside respectively of the dust container is changed due to decreasing $p_2$ during increasing filling degree of the dust container 10, this is transmitted by way of conduits 17 and 18 to the parts 15 and 16 of the indicator, and the diaphragm 14 moves to the right in the FIGURE against the tension of the spring 19. The aforesaid movement is transmitted to the dial 25 by means of a connecting rod, indicating on a scale increasing clogging of the dust container. For a certain degree of filling of the dust container the dial reaches its end position and indicates that the dust container should be replaced. In this operative condition the spring, and its tension, are optimally adapted to the given constant output.

In an apparatus with variable output, and without the possibility of changing the spring tension, a faulty indication of the degree of filling of the dust container by the indicator would take place. For instance, during decreased output, the dial 25 would indicate a lower clogging of the dust container than was the actual case, and the end position of the scale would be reached when the degree of filling of the dust container would be impermissibly high.

To avoid the above results, the regulating knob 22 of control unit 23 is also connected to the spring 19 in such a way that the spring tension can be varied at the same time as the motor output is changed. During decreased motor output the tension of the spring 19 at the same time is decreased through the knob 22 and the threaded shaft 21, which co-acts with a threaded hole in the housing so that the resistance against the movement of the diaphragm to the right in the FIGURE is lowered, and the given indicator information is correct. Otherwise, the dial would signal a lower degree of filling than the actual one, with the dangerous risk of overfilling of the dust container and consequent motor damage due to insufficient cooling of the motor.

A certain variation is obtained, even in this case, because the spring characteristics is unchanged in spite of changed tension of the spring, but this variation is negligible in actual practice. If, by means of the regulating knob 22 of the control unit, a higher motor output is set, the spring 19 through shaft 21 and plate 20 is simultaneously actuated so that the spring tension increases, that is, the shaft is screwed into the housing, and the length of the spring is shortened. Therefore, the spring tension is adapted to the higher output, and the dial reading is correct also in this operative condition.

The above embodiment is of course not intended to limit the invention to any extent. Sevaral modifications are thus possible within the scope of the claims since the manner of transmitting the regulating movement of the control units to vary the spring tension may be accomplished in several ways.

What is claimed is:

1. An arrangement for indicating the degree of clogging of a dust container for a vacuum cleaner, or the like, comprising a spring, a pressure sensing means, which under the influence of a pressure differential between the outside and inside of said dust container is movable against the force of said spring, a signalling device visible from the exterior of said vacuum cleaner for a continuous visual indication of the degree of clogging of the dust container and being operatively connected to said pressure sensing means, said vacuum cleaner having a motor regulator for varying the amount of the motor output, and said motor regulator being provided with a device for selective variance of the tension of said spring against the force causing said pressure sensing means to be movable.

2. The arrangement as claimed in claim 1 further comprising a housing for said pressure sensing means and said signalling device and wherein said pressure sensing means comprises a diaphragm that divides said housing into two parts, a pair of conduits which connect respective parts to the inside and outside respectively of the dust container.

3. The arrangement as claimed in claim 1 further comprising a regulating means and a control unit; a control shaft having said regulating means, control unit and said motor regulator connected thereto, and at least a part of said control shaft extending into said housing.

4. The arrangement as claimed in claim 3 wherein at least part of said shaft is threaded, and said housing is provided with a threaded hole for receiving said threaded portion whereby said shaft is movable axially along the longitudinal axis of said housing.

5. The arrangement as claimed in claim 4 further comprising a plate fixed to the end of said shaft in said housing, said plate bearing against one end of said spring, the other end of said spring engaging said pressure sensing means said plate during axial movement of said shaft relative to said signalling device changing the tension of said spring.

6. The arrangement as claimed in claim 3 wherein said device for varying the tension of said spring is integral with said regulating means of said control unit.

7. The arrangement as claimed in claim 3 wherein said control unit is a potentiometer.

* * * * *